US005433558A

United States Patent [19]

Gray

[11] Patent Number: 5,433,558

[45] Date of Patent: Jul. 18, 1995

[54] SELF-TAPPING, AND SELF-TAPPING AND SELF-DRILLING, ROCK BOLTS

[75] Inventor: Peter A. Gray, Fig Tree Heights, Australia

[73] Assignee: BHP Engineering Pty Ltd, Turner, Australia

[21] Appl. No.: 70,304

[22] PCT Filed: Oct. 29, 1991

[86] PCT No.: PCT/AU91/00503

§ 371 Date: Jun. 8, 1993

§ 102(e) Date: Jun. 8, 1993

[87] PCT Pub. No.: WO92/08040

PCT Pub. Date: May 14, 1992

[30] Foreign Application Priority Data

Oct. 29, 1990 [AU] Australia ..... PK3029

[51] Int. Cl.[6] ..... E21D 20/02

[52] U.S. Cl. ..... 405/259.1; 52/698; 411/387

[58] Field of Search ..... 405/259.1, 259.5, 259.6; 411/387; 52/698, 704

[56] References Cited

U.S. PATENT DOCUMENTS

| | | | |
|---|---|---|---|
| 1,288,893 | 12/1918 | Holmes | 411/387 X |
| 4,271,554 | 6/1981 | Grenell | 411/387 X |
| 4,697,969 | 10/1987 | Sparkes | 411/387 |
| 4,946,314 | 8/1990 | Gruber | 405/259.1 X |
| 5,074,729 | 12/1991 | Oba | 411/387 |

FOREIGN PATENT DOCUMENTS

| | | | |
|---|---|---|---|
| 80294/87 | 3/1988 | Australia . | |
| 1232538 | 1/1967 | Germany . | |
| 3145153 | 6/1983 | Germany . | |
| 3145923 | 6/1983 | Germany . | |
| 1215171 | 12/1970 | United Kingdom | 411/387 |
| 8907207 | 8/1989 | WIPO | 411/387 |

*Primary Examiner*—Dennis L. Taylor
*Attorney, Agent, or Firm*—Nikaido Marmelstein, Murray & Oram

[57] ABSTRACT

A self-tapping rock bolt having a discontinuous threaded profile with a plurality of cutting edges and at least one flute extending along the length of the rock bolt. The cutting edges are adapted to cut a threaded profile in the internal surface of a pilot hole so that the threaded profile of the rock bolt interlocks therewith. An internal axial hole is provided to enable water to be injected through the rock bolt as the threaded profile is being cut. The discontinuous threaded profile is tapered to form a lead-in section such that the height of the leading edge of each segment of the discontinuous threaded profile progressively increases from a leading end of the rock bolt.

13 Claims, 2 Drawing Sheets

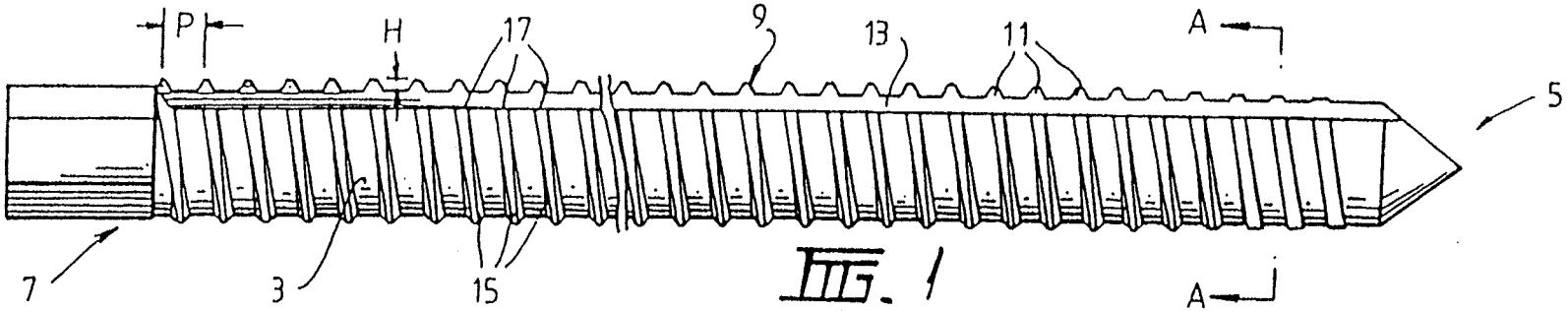
FIG. 1
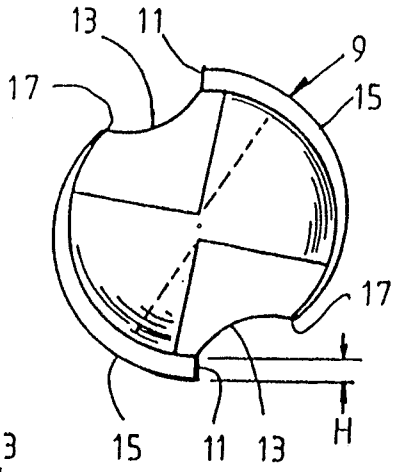
FIG. 6
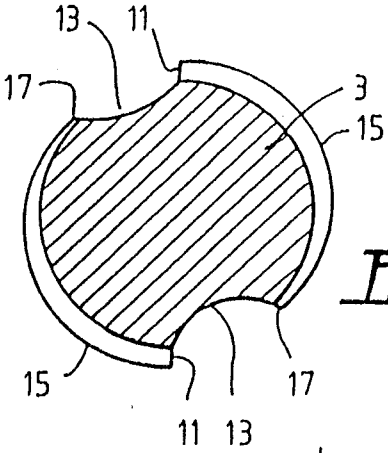
FIG. 2
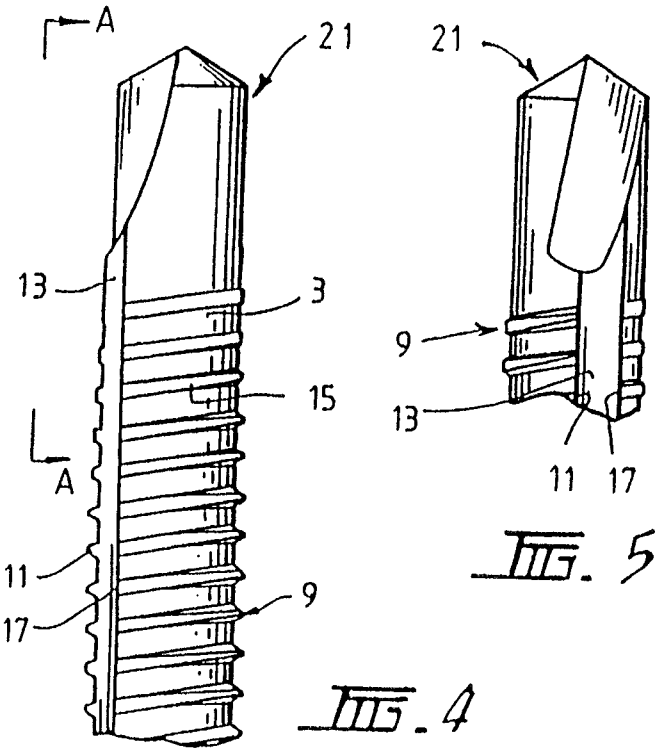
FIG. 4
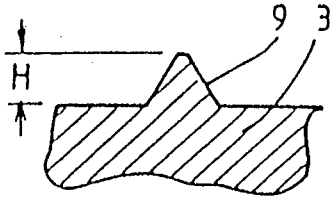
FIG. 3
FIG. 5

SELF-TAPPING, AND SELF-TAPPING AND SELF-DRILLING, ROCK BOLTS

The present invention relates to self-tapping rock bolts and to self-tapping and self-drilling rock bolts.

Rock bolts are designed to provide support resistance for excavations in rock, such as underground and surface mines, tunnels, cuttings, etc. They are an extremely effective way of supporting rock excavations and hence they have achieved high acceptance in both the mining and civil engineering industries.

Rock bolts come in many shapes and sizes, and two main types are solid rock bolts or tubular rock bolts. Solid rock bolts (e.g. deformed bar, dywidag, expansion shell, slot and wedge, etc.) have a solid central core to the bolt which provides the bolt with high tensile and shear strength characteristics. Tubular rock bolts on the other hand (e.g. split-sets, swellex, etc.) rely on the strength of the "tube" itself and hence normally have lower tensile and shear capacity than solid rock bolts.

Solid rock bolts maximise the ratio of cross sectional area of the rock bolt to cross sectional area of the rock bolt hole. Solid rock bolts therefore not only provide high tensile and shear strength capacity but also provide high tensile and shear stiffness characteristics. However, all solid rock bolts have a smaller cross sectional area than the cross sectional area of the hole in order to allow the rock bolt to be inserted into the rock bolt hole. As an example, solid rock bolts used in underground coal mines in Australia have a nominal diameter of 21.7 mm and are inserted into a borehole with a nominal diameter of 27 mm. There is therefore an annulus of approximately 2 mm between the surface of the rock bolt and the surface of the inside of the hole.

Solid rock bolts can be anchored into the rock bolt hole in two main ways, namely, with a cement or a chemical resin grout and with a mechanical locking device such as an expansion shell or a slot and wedge anchor.

In the case of a cement or resin grout, the grout forms a bond between the surface of the rock bolt and the internal surface of the hole. Therefore solid rock bolts used in this way often have a "rough" surface to increase the bond between the bolt and the grout (e.g. deformed bar, dywidag, T bolt, etc.).

However, little attention is given to the bond between the grout and the internal surface of the borehole. The process of drilling the rock bolt hole itself does create "roughness" on the internal surface of the hole, but this is not generally planned or designed in existing solid rock bolt systems. The only consideration is:given to the annulus size (i.e. the distance between the rock bolt and the wall of the hole), which is normally kept to a minimum (as indicated above), but this is primarily done to reduce the total amount of grout required rather than to increase the stiffness of the bolt/grout system.

Resin grout anchors normally use chemical cartridges or "sausages" to provide sufficient grout to anchor the rock bolt in the hole. The length of these sausages can be varied to change the length of the anchor so that in practice the rock bolt can be point anchored or fully encapsulated or somewhere in between these two extremes. The support response required and the rock type determine the length of grout anchor used but in normal circumstances the minimum length is 400–500 mm. Therefore, the bond between the rock and the grout is equally as important as the bond between the bolt and the grout.

Solid rock bolts with mechanical anchoring systems are designed to force a mechanical device or part of the bolt itself against the sides of the borehole by using either axial or rotational movement of the bolt. The most common examples of mechanical anchoring systems are expansion shells or slot and wedges and these normally provide a single point anchoring system at the end of the rock bolt hole. Therefore the surface profile of the solid rock bolt has no effect on the bolt capacity and in most cases these bolts are made from plain bars. Under extremely high loads these anchors tend to slip along the hole and these bolts can therefore accommodate considerable strain before failure.

Tubular rock bolts on the other hand are normally in intimate contact with the inside of the rock bolt hole.

In the case of split-sets, the diameter of the split-set is initially larger than the diameter of the rock bolt hole but its split tube design enables the diameter of the split-set to be reduced such that it can be inserted into the rock bolt hole. This is achieved by forcing the bolt into the hole and in so doing the split-set is "spring-loaded" against the inside surface of the rock bolt hole.

In the case of swellex bolts, the diameter of the bolt is initially less than the diameter of the rock bolt hole to allow insertion but the diameter is increased after the bolt is inserted in the hole by expanding the bolt with high pressure water.

Therefore, tubular rock bolts rely on the physical contact between the bolt and the rock bolt hole to provide axial shear strength capacity. For split-sets this is purely a frictional component. For swellex bolts, this is mainly a frictional component but there is some slight mechanical interlock between the bolt and the hole depending on the surface roughness of the borehole and the extent to which the swellex bolt has been deformed to the internal surface profile of the hole.

Tubular rock bolts have some advantages in handling and installation over solid rock bolts but their axial and shear capacity is normal significantly less than that for solid rock bolts.

An object of the present invention is to provide a rock bolt which optimises the ratio of the cross sectional area of the rock bolt to the cross-sectional area of the rock bolt hole, which is an advantage of solid rock bolts, and at the same time physically interlocks the rock bolt and the internal surface of the hole, which is an advantage of tubular rock bolts.

According to the present invention there is provided a self-tapping rock bolt comprising:

(a) a discontinuous threaded profile having a plurality of cutting edges, the cutting edges adapted to cut a threaded profile in the internal surface of a pilot hole so that the threaded profile of the rock bolt interlocks with the threaded profile cut in the rock; and (b) at least one flute extending along the length of the rock bolt to facilitate removal from the hole of material cut by the cutting edges.

It is preferred that the rock bolt comprises a hole extending along the length thereof to enable water to be injected through the rock bolt into the pilot hole as the threaded profile is being cut.

It is particularly preferred that the cross-sectional area of the hole is less than or equal to 50% of the total cross-sectional area of the rock bolt.

It is preferred that the or each flute is formed as a flat along the length of the rock bolt.

It is preferred that the rock bolt comprises two diametrically opposed axially extending flutes.

With such an arrangement, it is preferred that the threaded profile comprises a plurality of segments between the flutes, each segment extending around the rock bolt from a leading edge adjacent to one of the flutes to a trailing edge adjacent to the other of the flutes.

With such an arrangement, it is preferred that the leading edge of each segment defines one of the cutting edges.

It is particularly preferred that the height of the threaded profile is a maximum at the leading edges and gradually reduces to-the trailing edges.

It is preferred that the ratio of the pitch of the threaded profile and the maximum height of the threaded profile is in the range of 3:1 to 6:1. It is particularly preferred that the ratio is in the range of 4:1 to 5:1.

It is preferred that the rock bolt comprises a lead-in section formed by tapering the threaded profile such that the height of the leading edge of each segment progressively increases from the leading end of the rock bolt. It is particularly preferred that the full thread height is not achieved until approximately 4 or 5 threads from the leading end of the rock bolt. With such an arrangement, the rock bolt is able to progressively increase the depth of the threaded profile cut in the rock thus minimising rock breakage between adjacent threads of the threaded profile.

It is preferred that the rock bolt further comprises a reamer at the leading end to enlarge the diameter of the pilot hole so that the pilot hole can receive the core of the rock bolt.

According to the present invention there is also provided a self-drilling and self-tapping rock bolt comprising the self-tapping rock bolt described in the preceding paragraphs and a means to cut a hole for the rock bolt.

It is preferred that the cutting means comprises a cutting bit at the leading end of the rock bolt to drill the hole.

It is particularly preferred that the cutting bit is detachable.

The present invention is described further with reference to the accompanying drawings in which:

FIG. 1 is a side elevation of a preferred embodiment of a self-tapping rock bolt formed in accordance with the present invention;

FIG. 2 is a cross-sectional view along the line A—A in FIG. 1;

FIG. 3 is a cross-sectional view of the threaded profile of the rock bolt shown in FIGS. 1 and 2;

FIG. 4 is a side elevation of another preferred embodiment of a self-tapping rock bolt formed in accordance with the present invention;

FIG. 5 is a side elevation of the section of the rock bolt between the arrows A—A in FIG. 4 as viewed in the direction of the arrows;

FIG. 6 is a plan view of the leading end of the rock bolt shown in FIGS. 4 and 5;

Figure 7:
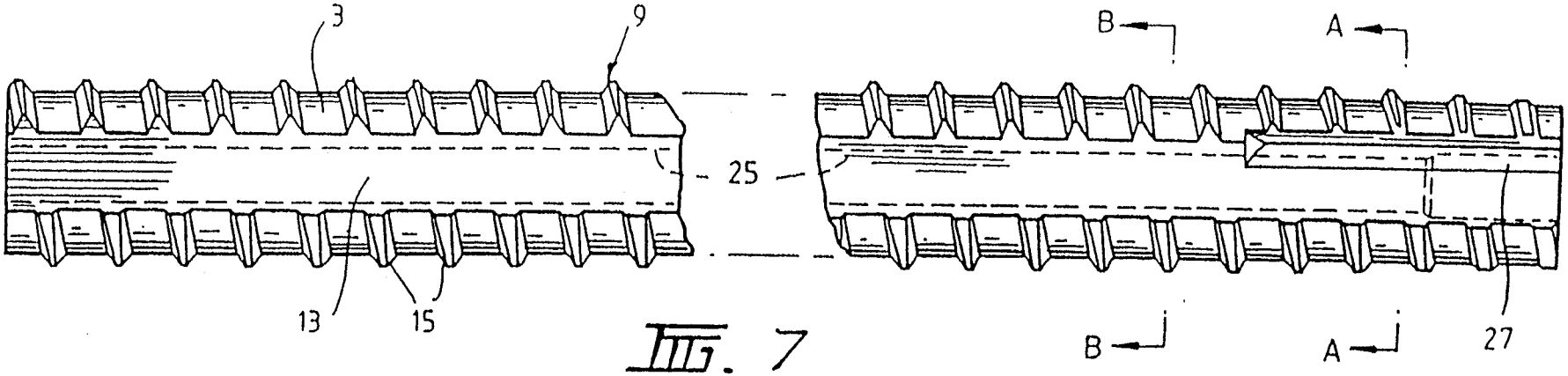
FIG. 7 is a side elevation of another preferred embodiment of a self-tapping rock bolt formed in accordance with the present invention.

The preferred embodiments of the self-tapping rock bolt shown in FIGS. 1 to 9 are adapted for insertion into a pilot hole (not shown) to cut a threaded profile in the rock formation which defines the internal wall of the pilot hole with minimal damage to the rock formation between adjacent threads of the threaded profile.

The self-tapping rock bolt shown in FIGS. 1 to 3 is formed from any suitable material and comprises a solid core 3, a pointed leading end 5 for convenient insertion into a pilot hole (not shown), a trailing end 7, a discontinuous threaded profile, generally identified by the numeral 9, with a plurality of cutting edges along the length thereof, and a pair of diametrically opposed concave flutes 13 which extend along the length of the rock bolt.

With reference to FIG. 2 in particular, it is noted that the flutes 13 in effect divide what would otherwise be a continuous threaded profile into the discontinuous threaded profile 9 shown in the figures.

With further reference to FIG. 2 in particular, the threaded profile 9 comprises a plurality of segments 15, each segment 15 extending around the core 3 from a leading edge 11 adjacent to one of the flutes 13 to a trailing edge 17 adjacent to the other of the flutes 13. The height of the threaded profile 9 is a maximum H at the leading edges 11, which define the cutting edges of the threaded profile, and gradually reduces to the trailing edges 17 at an angular reduction of about 5 degrees. The maximum height H is selected so that the ratio of the pitch P (FIG. 1) and the maximum height H of the threaded profile 9 is nominally 5:1 in order to minimise damage to the rock formation between adjacent threads of the threaded profile cut in the rock formation.

With reference to FIG. 1, the threaded profile 9 is tapered in the region of the leading end 5 of the core 3 to form a lead-in section to enable the cutting edges to progressively increase the depth of the threaded profile cut in the rock formation as the rock bolt is rotated ihto a pilot hole and thereby to minimise excessive rock breakage between adjacent threads of the threaded profile cut in the rock formation.

In use of the self-tapping rock bolt shown in FIGS. 1 to 3, the leading end 5 of the rock bolt is inserted into a pilot hole and the rock bolt is then rotated about its axis so that the leading edges 11 of the threaded profile 9 cut a threaded profile in the rock formation which defines the internal surface of the pilot hole. The gaps between the internal surface of the pilot hole and the flutes 13 define passages for removing rock cuttings so that the rock bolt is not progressively clogged by the rock cuttings. It can readily be appreciated that as the rock bolt is rotated into the pilot hole the threaded profile cut into the rock formation progressively receives the threaded profile of the rock bolt with the result that there is formed a significant mechanical interlock between the rock bolt and the rock formation which is greater than that formed with tubular rock bolts. It can also be readily appreciated that the rock bolt substantially occupies the whole of the cross-section of the pilot hole and thereby maximises the ratio of cross-sectional area of the rock bolt to cross-sectional area of the pilot hole, and thus has one of the main advantages of solid rock bolts.

It is noted that as the rock bolt is rotated into the pilot hole the cutting edges of the threaded profile 9 tend to clean out the threaded profile in the rock formation of all fine rock particles. In addition, the reduction in the height H of each segment 15 between the leading edge 11 and the trailing edge 17 has the beneficial effect that if the rock bolt is unscrewed fine rock particles that had not been cleaned out tend to be jammed in the decreasing space between the threaded profile 9 and the rock formation, and in this way the rock bolt is to some extent self-locking. A further beneficial effect of the height reduction of each segment 15 of the threaded profile 9 is that a relatively lower torque is required to turn the rock bolt to cut the threaded profile in the rock formation.

The lead-in section of the rock bolt defined by the tapered threaded profile 9, which progressively cuts the threaded profile in the rock formation, is subject to excessive wear rates. However, this is not a limitation since, as the wear occurs, the tapered threaded profile simply becomes longer, the progressive cutting action of the rock bolt becomes greater, and the threaded profile cut into the rock formation is more cleanly and efficiently formed.

The self-tapping rock bolt shown in FIGS. 4 to 6 comprises the rock bolt shown in FIGS. 1 to 3 modified to include a reamer 21 at the leading end instead of the pointed leading end 5 shown in FIGS. 1 to 3. The purpose of the reamer 21 is to enlarge the pilot hole to accommodate the core 3 in situations where this is necessary. In this regard, in many instances the inside surface of the pilot hole tends to be spiralled and non-uniform and this can lead to problems in positioning the rock bolt in the pilot hole. The purpose of the reamer 21 in such situations, therefore, is to clean out an initial non-uniform pilot hole to form a uniform, optimally sized pilot hole suitable for accommodating the core 3.

Figure 8:
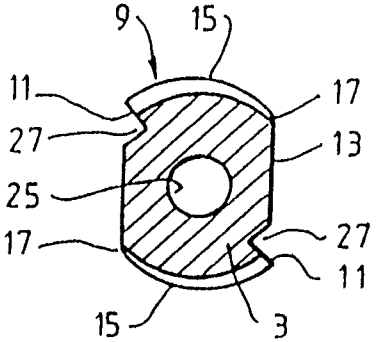
FIG. 8 is a cross-sectional view along the line A—A in FIG. 7.
Figure 9:
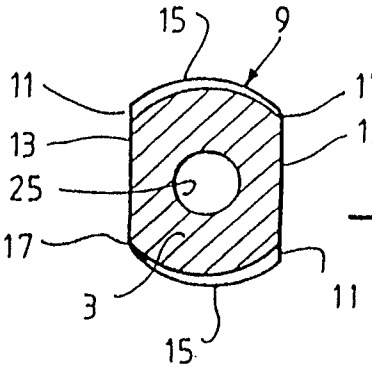
FIG. 9 is a cross-sectional view along the line B—B in FIG. 7.

The self-tapping rock bolt shown in FIGS. 7 to 9 has the same basic configuration as the rock bolts shown in FIGS. 1 to 6. The main features of the rock bolt that are not present in the rock bolts shown in FIGS. 1 to 6 are summarised below.

(a) The rock bolt has an internal axially extending hole 25 to enable water to be pumped through the rock bolt into the pilot hole during insertion of the rock bolt. The main functions of the water are to:
  (i) flush rock cuttings out of the pilot hole along the flutes 13;
  (ii) reduce the overall friction between the rock bolt and the rock and hence reduce the torque required to install the rock bolt; and
  (iii) reduce the temperature of the cutting edges of the threaded profile 9 so that the wear is reduced and the cutting efficiency is maintained.

(b) The flutes 13 are formed by two flats. The flats are easier to form than the concave configuration of the rock bolts shown in FIGS. 1 to 6 and are an advantage from this viewpoint. A further advantage is that the flats enable the rock bolt to be rotated at any point along its length. As a consequence, a special hexagonal nut does not have to be formed on the end of the rock bolt and, moreover, the rock bolt can be used with a through chuck on a drilling machine.

(c) The lead-in of the rock bolt comprises a cutting flute 27 formed in the flutes 13 so that each leading edge 11 of the threaded profile has a sharp cutting edge.

With regard to item (a) above, the size of the hole 25 may be selected as required for a given application. Nevertheless, it has been found that the hole size may be up to 60%, more preferably 50%, of the total cross-sectional area of the rock bolt. In addition to minimising steel requirements and the weight of the rock bolt, such relatively large hole sizes allow a coupler to be inserted internally to the rock bolt.

A series of tests carried out on the rock bolt shown in FIGS. 7 to 9 with the following dimensions have shown that the anchor strength is approximately 1 tonne/cm of embedment in sandstone.

Core diameter: 26 mm
Pitch: 10 mm
Maximum thread height: 2.5 mm

With the above in mind, if the tensile strength of the steel of the rock bolt is 30 tonnes, a 30 cm embedment of the rock bolt would be as strong as the steel.

It follows from the foregoing that the rock bolt shown in FIGS. 7 to 9 can be used in a range of situations varying from full anchoring along the length of the rock bolt to point bonding. For example, at one extreme a 3 m long 30 tonne rock bolt could be screwed in a rock formation along its entire length and have very stiff support characteristics, as may be required in a particular application. Alternatively, at the other extreme, in order to take into account the requirements of another application, the same rock bolt could be installed into a rock formation only over the last 50 cm of its length and the remainder of the rock bolt extending through a pilot hole of slightly larger diameter than that of the rock bolt. In this case, the support response of the rock bolt would be less stiff but with the same ultimate tensile strength.

Figure 10:
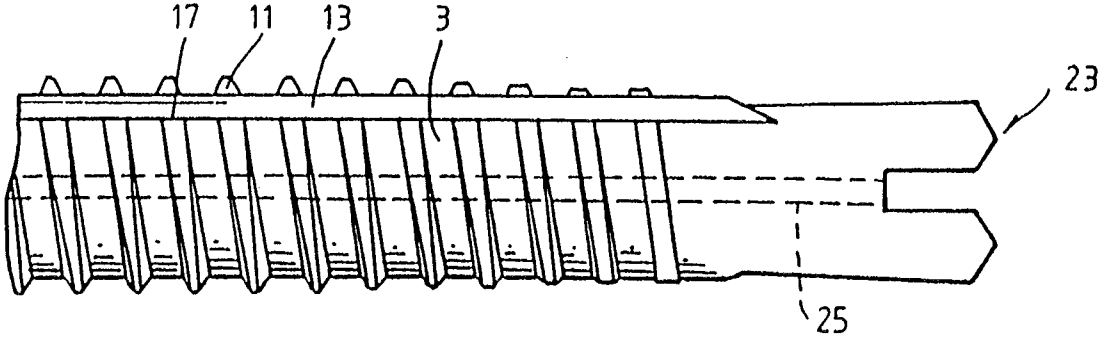
FIG. 10 is a side elevation of a preferred embodiment of a self-drilling and self-tapping rock bolt formed in accordance with the present invention.

The preferred embodiment of the self-drilling and self-tapping rock bolt shown in FIG. 10 comprises the self-tapping rock bolts shown in FIGS. 1 to 6 modified to include a cutting bit 23 at the leading end instead of the pointed leading end 5 shown in FIGS. 1 to 3 and the reamer 21 shown in FIGS. 4 to 6. The purpose of the cutting bit 23 is to form the pilot hole. The rock bolt further comprises a central axially extending hole 25 to enable water to be injected through the rock bolt.

Many modifications may be made to the preferred embodiment of the self-tapping rock bolt without departing from the spirit and scope of the present invention.

For example, whilst the preferred embodiments comprise two diametrically opposed axially extending flutes 13, it can readily be appreciated that the present invention is not so limited and the flutes 13 can be in any suitable form, configuration and number to efficiently remove cut rock from the pilot hole.

Furthermore, whilst the preferred embodiments comprises an optimum angular reduction of 5 degrees of the height of the threaded profile 9 from the cutting edges to the trailing edges, it can readily be appreciated that the present invention is not limited to this reduction of the height of the threaded profile.

Furthermore, whilst the preferred embodiments shown in FIGS. 1 to 6 comprise a ratio of 5:1 between the pitch P and the maximum height H of the threaded profile 9 and the preferred embodiment shown in FIGS. 7 to 9 comprises a ratio of 4:1 between the pitch P and the maximum height of the threaded profile 9, it can readily be appreciated that the present invention is not so limited and the ratio may be selected as required to minimise rock damage of the rock formation between adjacent threads of the threaded profile for a given geology of rock formation.

The claims defining the invention are as follows:

1. A self-tapping rock bolt for cutting a threaded profile in an internal surface of a pilot hole comprising:

(a) at least one flute extending along the length of the rock bolt to facilitate removal from the pilot hole of material cut by the rock bolt;

(b) a hole extending along the length of the rock bolt to enable water to be injected through the rock bolt into the pilot hole as the threaded profile is being cut;

(c) a discontinuous threaded profile having a plurality of cutting edges, the cutting edges being adapted to cut the threaded profile in the internal surface of the pilot hole, and said discontinuous threaded profile being adapted to interlock with the threaded profile cut in the internal surface of the pilot hole, said discontinuous threaded profile comprising a plurality of segments, each segment extending around the rock bolt from a leading edge to a trailing edge, with the leading edge of each segment defining one of the cutting edges; and (d) a lead-in section formed by tapering said discontinuous threaded profile such that the height of the leading edge of each segment progressively increases from a leading end of the rock bolt.

2. The rock bolt defined in claim 1, wherein the cross-sectional area of said hole is less than or equal to 60% of the total cross-sectional area of the rock bolt.

3. The rock bolt defined in claim 1, wherein the or each flute is formed as a flat along the length of the rock bolt.

4. The rock bolt defined in claim 1, wherein the rock bolt comprises two diametrically opposed axially extending flutes.

5. The rock bolt defined in claim 4, wherein the height of said discontinuous threaded profile is a maximum at the leading edges and:gradually reduces to the trailing edges.

6. The rock bolt defined in claim 5, wherein the angular reduction of said discontinuous height of the threaded profile between the leading and trailing edges is at least 4 degrees.

7. The rock bolt define in claim 1, wherein the ratio of the pitch of said discontinuous threaded profile and the maximum height of said discontinuous threaded profile is in the range of 3:1 to 6:1.

8. The rock bolt defined in claim 7, wherein the ratio is in the range of 4:1 to 5:1.

9. The rock bolt defined in claim 1, wherein full thread height is not achieved until 4 or 5 threads from the leading end of the rock bolt.

10. The rock bolt defined in claim 1, further comprising a reamer at the leading end to enlarge the diameter of the pilot hole to the diameter of the core of the rock bolt.

11. A self-drilling and self-tapping rock bolt comprising the self-tapping rock bolt defined in claim 1 and a means to cut a hole for the rock bolt.

12. The rock bolt defined in claim 11, wherein the cutting means comprises a cutting bit at the leading end of the rock bolt to drill the hole.

13. The rock bolt defined in claim 12, wherein the cutting bit is detachable from the rock bolt.

* * * * *